US005810491A

United States Patent [19]

Müller et al.

[11] Patent Number: 5,810,491

[45] Date of Patent: Sep. 22, 1998

[54] SPLASH WATER PROTECTED KEYBOARD

[75] Inventors: Karl-Heinz Müller, Auerbach, Germany; Khalleel M. Chowdhree, Watford, England

[73] Assignee: Cherry Mikroschalter GmbH, Auerbach, Germany

[21] Appl. No.: 885,784

[22] Filed: Jun. 30, 1997

[30] Foreign Application Priority Data

Jul. 2, 1996 [DE] Germany ..... 196 26 626.2

[51] Int. Cl.[6] ..... B41J 29/12

[52] U.S. Cl. ..... 400/496; 400/472

[58] Field of Search ..... 400/472, 490, 400/496, 479.1; 200/302.2

[56] References Cited

U.S. PATENT DOCUMENTS 5,172,805 12/1992 Gumb ..... 200/341
5,180,237 1/1993 Chen ..... 400/479
5,421,659 6/1995 Liang ..... 400/472
5,494,363 2/1996 Hochgesang ..... 400/472
5,642,950 7/1997 Hochgesang et al. ..... 400/472
5,674,018 10/1997 Kaufman et al. ..... 400/490
5,681,122 10/1997 Burke ..... 400/472
5,697,718 12/1997 Erler et al. ..... 400/496

*Primary Examiner*—Edgar S. Burr
*Assistant Examiner*—Leslie Grohusky
*Attorney, Agent, or Firm*—Klaus J. Bach

[57] ABSTRACT

In a splash-water protected keyboard having a contact foil arranged in a housing and a rubber mat with switch domes disposed over the contact foil and keys with contact stems disposed in the housing over the switch domes for actuating the contacts in the contact foil, the rubber mat has upwardly extending circumferential projections such that the rubber mat forms a trough structure which is provided at least at one edge with discharge spouts extending into openings in the housing bottom plate for discharging any liquid collected in the trough structure.

9 Claims, 4 Drawing Sheets

SPLASH WATER PROTECTED KEYBOARD

BACKGROUND OF THE INVENTION

The invention relates to a splash water protected keyboard with a housing and contact structures disposed in the housing and covered by a protective rubber sheet with rubber domes disposed over the contact structures which are deformable for actuating the contacts below. Keys are disposed over the contact structures which are formed on a contact foil disposed in the housing. The arrangement and operation of such a protective rubber sheet and contact foil are described for example in DE OS 44 42 073.

Such keyboards are generally known and widely used. Generally, the housing comprises a bottom plate and an upper housing part which is provided with a multitude of openings through which the keys project. The keys are supported on a bed plate which carries the contacts. The keys extend through the openings in spaced relationship so as to be freely movable. However, liquid may enter through the gaps around the keys so that liquid splashed onto the keyboard may enter between the keys particularly if the keys are located somewhat lower than the surrounding edge portion of the keyboard as it is often the case for design or ergonomic reasons.

Water protected keyboards are known but they are often so designed that the interior of the keyboard is totally sealed. Also, the various keys may be sealed separately. Such sealing structure however can be provided only with expensive design features such as by using additional sealing mats or by molding or cementing foils onto the keyboard as it is done with the so-called foil keyboards.

Further, DE OS 31 42 367 discloses a splash water protected keyboard which includes in the protective rubber mat a groove-like recess around each key. The groove like recesses are in communication and end at least at one side of the protective mat in order to permit outflow of any liquid splashed onto the top side of the protective mat. However, the use of such a structured protective mat with a standard keyboard will not provide for the optimum collection and discharge of water splashed onto the keyboard.

It is the object of the present invention to provide a splash water protected keyboard with a housing that includes few design changes but still provides for improved splash water protection.

SUMMARY OF THE INVENTION

In a splash-water protected keyboard having a contact foil arranged in a housing and a rubber mat with switch domes disposed over the contact foil and keys with contact stems disposed in the housing over the switch domes for actuating the contacts in the contact foil, the rubber mat has upwardly extending circumferential projections such that the rubber mat forms a trough structure which is provided at least at one edge with discharge spouts extending into openings in the housing bottom plate for discharging any liquid collected in the trough structure.

By providing circumferential projections on the protective rubber mat with key receiving domes as it is used generally with keyboards, there is provided a containment structure in which liquid passing through the gaps around the keys is collected and conducted to a lower level area which is generally the area along the edge adjacent the keyboard operator. In this lower level area, the rubber mat has outflow passages and the keyboard bottom plate has corresponding openings for the discharge of any liquid.

Because of the usual inclination of the keyboard and the rubber mat in the normal keyboard position, any liquid collected in the containment structure is discharged from the keyboard through the openings in the keyboard bottom plate without reaching the switch foil disposed below the rubber mat.

The keyboard housing top part is connected to the bottom part by snap-in detents which extend through the rubber mat. The rubber mat is, according to another embodiment of the invention, provided with additional upwardly projecting collar structures which extend around the detents.

Furthermore, the rubber mat may be provided in the area of the discharge openings with spouts which extend into the housing openings in the housing bottom part. Also the circumferential projections may be increased at the lower end if the rubber mat is to be disposed in an inclined position.

In order to stabilize the circumferential edge of the rubber mat, the circumferential edge is received in a slot-like space which is formed by an upwardly extending edge portion of the bottom housing part and an upper housing part and a reinforcement rib extending downwardly from the housing top part.

For further protection of switch foil the bottom side of the rubber mat has a sealing lip formed thereon preferably in the area of the circumferential edge remote from the operator which provides for additional sealing of the switch foil at the housing top part since the reinforcement rib is disposed on the rubber mat. This is particularly advantageous if the keyboard has an additional row of keys further back, that is, function keys which have their own switch foil and their own rubber mat and which have no particular pan structure since they are on a less dangerous location. Also, in this case, the rubber mat may be provided with seal lips which provide for a seal with the switch foil as the reinforcement ribs are disposed on the rubber mat.

For keyboards which have a single-structure rubber mat for the front key area and the rear key area (that is the function keys), the rubber mat is provided in the area between one of the rear rows of keys and the front key rows with special flow barriers which project from the top of the rubber mat and extend from a central area outwardly in order to conduct liquid entering the rear key area to the front discharge openings of the keyboard by way of passages disposed between the flow barriers.

The features and advantages of the invention will become more readily apparent from the following description of various embodiments on the basis of the accompanying drawings.

DESCRIPTION OF PREFERRED EMBODIMENTS

Figure 1:
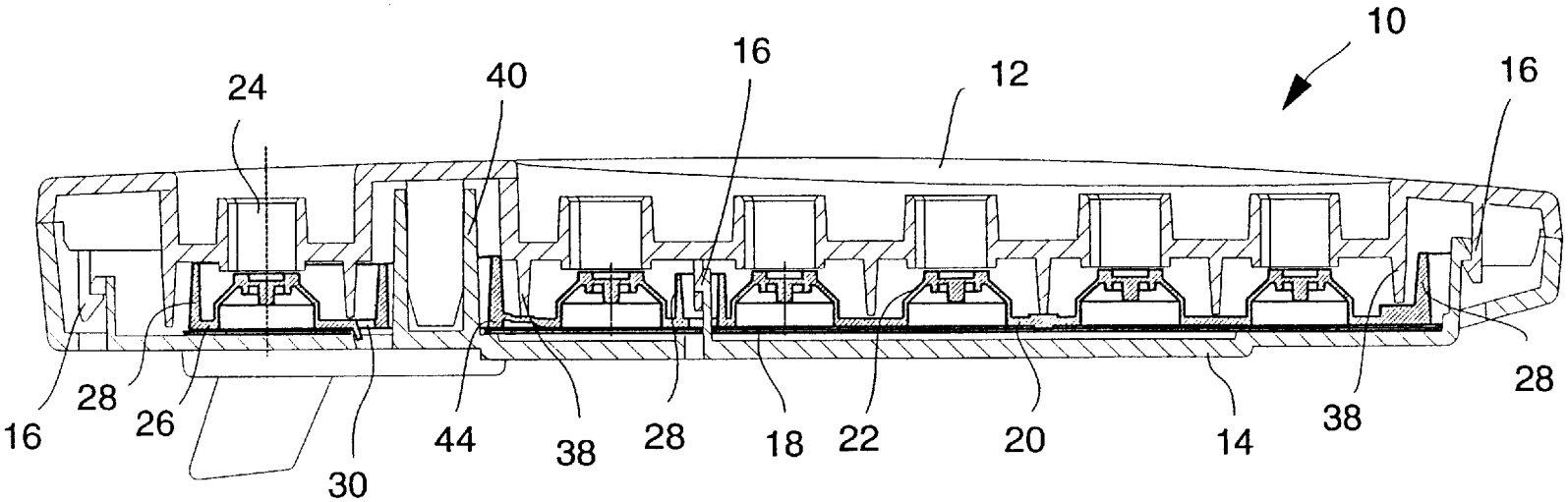
FIG. 1 is a cross-sectional view of a splash-water protected keyboard.

From the cross-sectional view of the foil keyboard 10 shown in FIG. 1, it can be seen that the keyboard housing comprises a housing top part 12 and a bottom plate 14 which are interconnected by snap-in detents 16. The bottom plate includes a rigid bed plate on which a switch foil 18 is disposed and a rubber mat 20 disposed on the switch foil 18. In the contact areas of the switch foil, the rubber mat 20 is provided with switch domes 22 on which an key stem of a key 46 (FIG. 3) is disposed which is inserted in the key mount 24.

As shown in FIG. 1, the keyboard may have a separate rear row of keys which serve as function keys and may include a separate rubber mat 26 with a switch foil also disposed on a bottom plate.

The rubber mat 20 as well as the rubber mat 26 for the function keys include each a circumferential projection 28 whose upper edge is preferably disposed above the level of the switch domes 22.

There are also a projections 28 which extends collar-like around the snap-in detents 16 and have openings for receiving the snap-in detents.

Generally, keyboards and consequently, the switch foil 18 or the rubber mat 20 respectively are disposed at an angle of about 6° with respect to the support table on which the keyboard is placed. As a result, there is a slope so that liquid entering by way of the key mounts 24 flows within the trough formed by the circumferential projection toward the lower end of the keyboard adjacent the operator.

Figure 2:
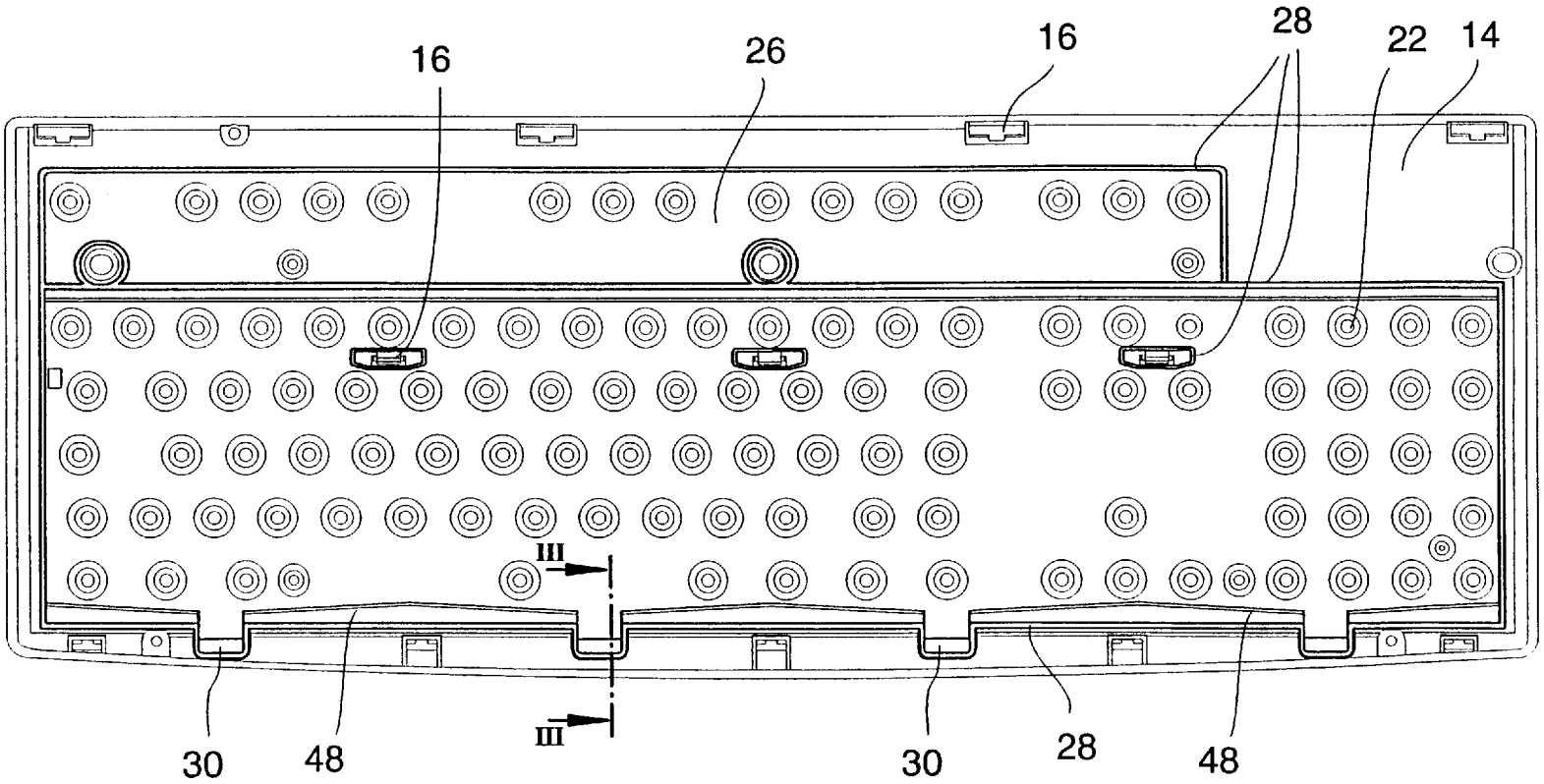
FIG. 2 is a top view of a switch mat disposed in a bottom plate with the cover removed.
Figure 3:
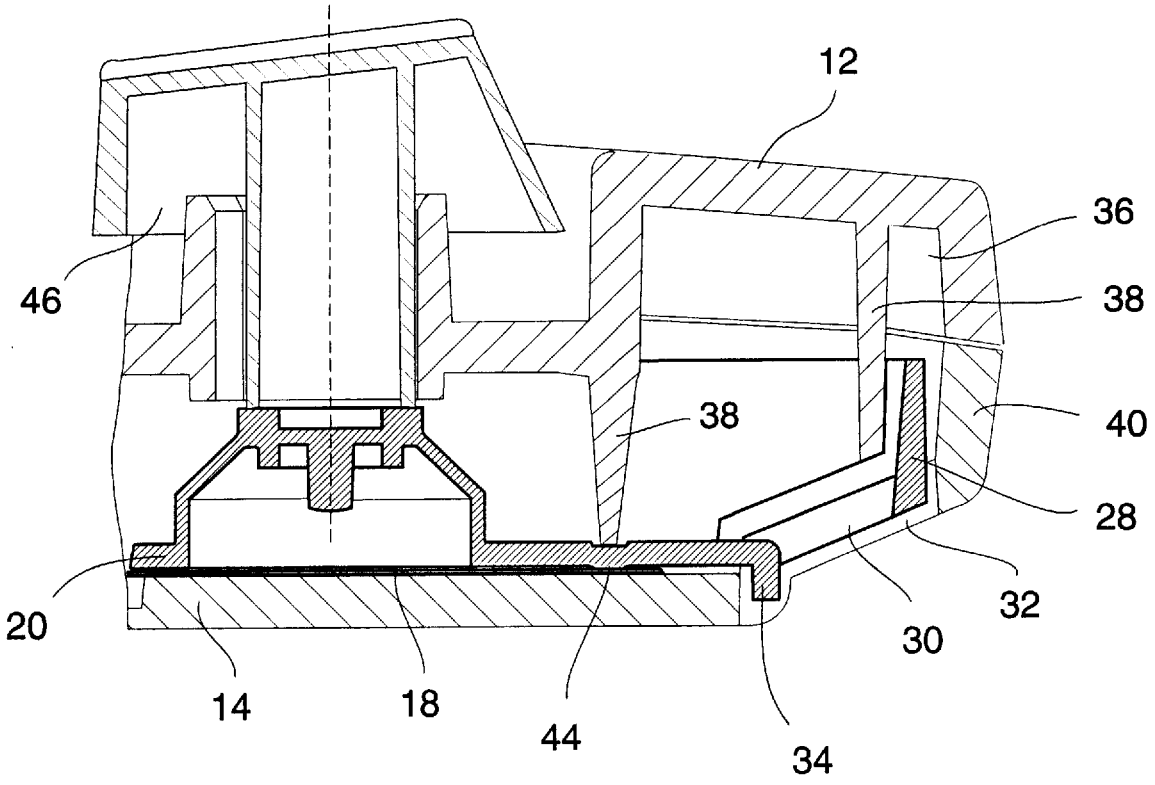
FIG. 3 is an enlarged partial cross-sectional view of the operator end of a keyboard taken along line III—III of FIG. 2.

As can be seen from FIGS. 2 and 3, the trough is provided at the lower end adjacent the operator with discharge spouts 30 which extend into openings 32 in the bottom plate 14 and which have a drip lip 34 so that liquid splashed onto the keyboard can be discharged through the discharge spouts and the bottom plate openings 32.

The circumferential projection 28 of the rubber mat 20 which is flexible like the rubber mat can be stabilized by being received in a slot-like space 36 which is defined in the housing top part 12 between reinforcement ribs 38 and the end wall 40 of the bottom plate 14. In this way, the circumferential projection of the rubber mat is held in an upright position.

In a preferred embodiment of the invention, the rubber mat has, in the area below the reinforcement rib 38, a seal lip 44 which is pressed by a reinforcement rib 38 onto the bottom plate when the housing top part is mounted onto the housing bottom plate and which provides, with a corresponding shape of the switch foil, an additional seal with respect to the switch foil 18.

In an actual embodiment of the invention, the rubber mat has a circumferential projection of a height of about 6 mm. Depending on the design of the keyboard and its design inclination the height of the projection may be increased from the end of the keyboard remote from the operator toward the end adjacent the operator.

For further improved water discharge flow, the trough formed by the rubber mat may be provided at the front end adjacent the operator with discharge barriers in the form of trapezoidal slightly raised extensions 48 which are formed onto the rubber mat and which are disposed on corresponding projections formed on the bottom plate. They provide for an additional slope toward the discharge spouts 30. As apparent from FIG. 2, the discharge spouts 30 project from the circumferential projections 28 slightly forwardly toward the operator so that the spouts 30 extend up to the front edge of the keyboard and are disposed at the lowest points of the rubber mat.

Figure 4:
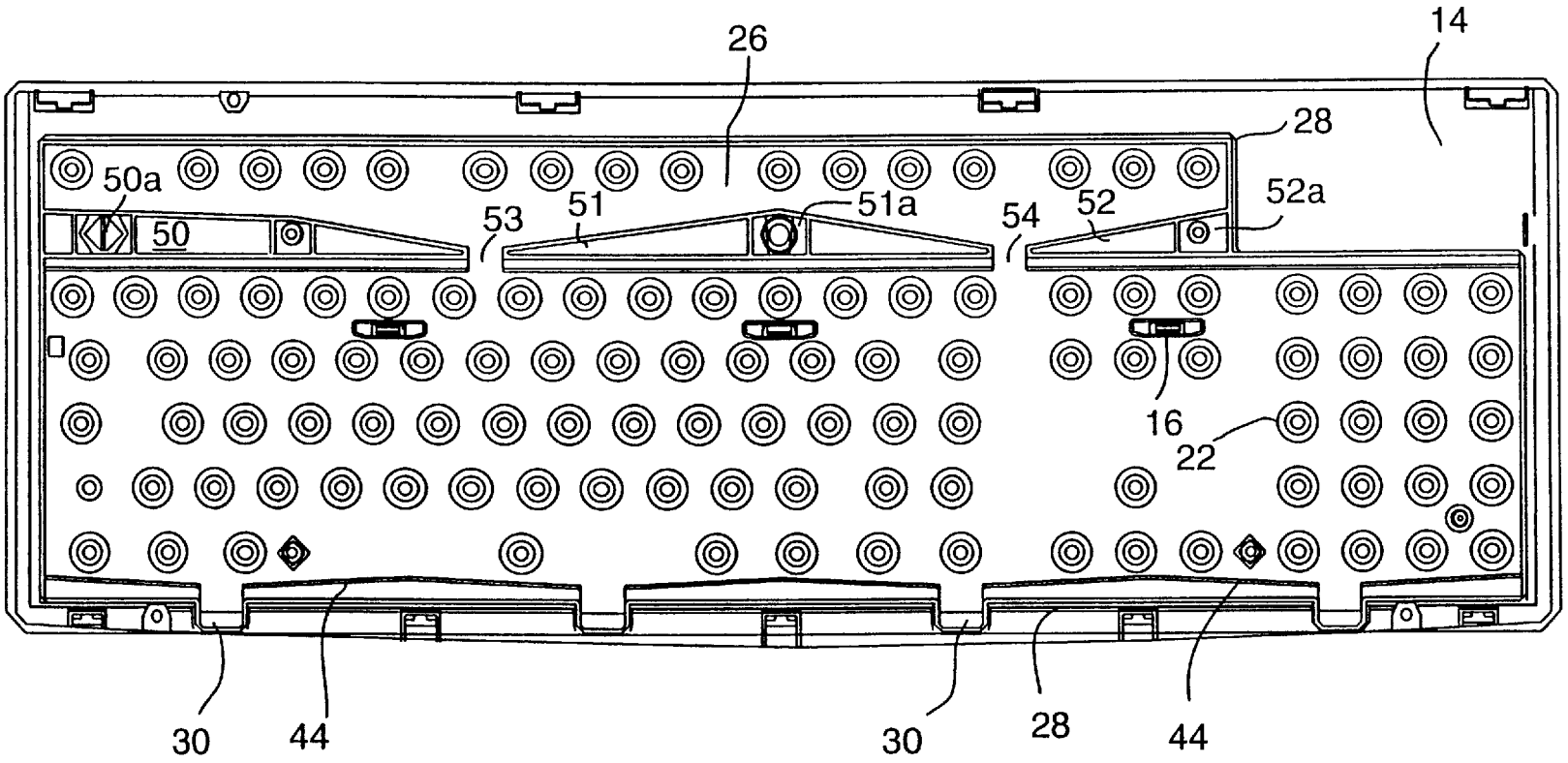
FIG. 4 is a view similar to that of FIG. 2 showings a switch mat disposed in a housing bottom plate and having additional flow barriers arranged in the area of the rear keys.

FIG. 4 shows a keyboard similar to that shown in FIG. 2 with a switch mat disposed on the bottom plate and provided with additional flow barriers 50, 51, 52 arranged in the area of the rear row of keys. Between the three flow barriers 50, 51, 52 shown in FIG. 4 in an exemplary manner, there are flow passages 53, 54. The flow barriers 50, 51, 52 formed on the top side of the rubber mat extend from an area of increased thickness 50*a*, 51*a*, 32*a* to their outer ends and away from the rear row of keys such that the flow barriers slope toward the flow passages 53, 54 and to the front discharge openings of the keyboard.

With the arrangement according to the invention liquid that has entered the keyboard is first collected in the trough formed by the rubber mat and is then discharged through the front openings. In this manner the liquid entering the keyboard is prevented from reaching the contact area of the switch foil thereby preventing contact failures.

Since also the passages in the rubber mat in the area of the snap-in detents are provided with collar-like projections no liquid entering the keyboard can reach the switch foil.

The features of the present invention can be utilized for conventional standard keyboards without expensive design changes so that they provide for a relatively inexpensive solution for splash water protected keyboards. Tests have shown that even relatively large amounts of liquid spilled over the keyboard can be accommodated since more liquid can be collected and discharged through the discharge spouts 30 of the trough-shaped rubber mat than can flow through the gaps in the keyboard housing top. The invention can be utilized without any changes to the relatively complicated keyboard housing top part. The discharge openings are all disposed in the bottom pan which is a simple injection molded structure. The discharge openings may be provided simply by additional inserts in the mold or by additional slide members extending into the mold during injection molding.

The same is true if an extended key has additional key arrangements and these additional key arrangements have their own rubber mat with separate discharge openings.

What is claimed is:

1. A splash water protected keyboard comprising a housing with a bottom plate and a housing top part, a contact foil including contacts arranged in said housing, a rubber mat with switch domes disposed over said contact foil, and keys with key stems disposed in said key board above said switch domes for actuating the contacts in said contact foil through said switch domes, said rubber mat having an upwardly extending circumferential projection such that said rubber mat forms a trough structure, said rubber mat having at least at one of its circumferential edges discharge spouts and said housing bottom plate having openings into which said discharge spouts extend.

2. A keyboard according to claim 1, wherein said housing top part is mounted onto said housing bottom plate by detents extending through said rubber mat and said rubber mat is provided with collars extending upwardly around said detents.

3. A keyboard according to claim 1, wherein said spouts have drip lips at their ends in said bottom plate openings.

4. A keyboard according to claim 1, wherein said rubber mat has a discharge end with trapezoid-shaped raised flow barriers formed at its discharge end providing for a slope conducting liquid toward said discharge spouts.

5. A keyboard according to claim 1, wherein said circumferential projection is higher at one end of said rubber mat than it is at the other end of said rubber mat.

6. A keyboard according to claim 5, wherein at least at the lower end of the rubber mat the circumferential projection engages a correspondingly high side wall of said housing bottom plate.

7. A keyboard according to claim 1, wherein said housing bottom plate includes a side wall and said housing top part includes a downwardly extending reinforcement rib forming a slot-like space between said reinforcement rib and said rubber mat, said circumferential projection of said rubber mat extending into said slot-like space.

8. A keyboard according to claim 1, wherein said rubber mat has a seal lip formed at its bottom side and said housing top part has a reinforcement rib extending downwardly into contact with said rubber mat above said seal lip so as to force said seal lip into engagement with said contact foil below.

9. A keyboard according to claim 1, wherein at the rear end of said keyboard opposite an operator said keyboard has additional keys and said rubber mat has flow barriers formed on the top side thereof with spaced discharge passages for conducting liquid toward said discharge spouts, said flow barriers having an increasing thickness away from said discharge passages so as to form slopes leading liquid toward said discharge spouts.

* * * * *